US005332446A

United States Patent [19]

Didier et al.

[11] Patent Number: 5,332,446

[45] Date of Patent: Jul. 26, 1994

[54] METHOD FOR CONTINUOUS PICKLING OF STEEL MATERIALS ON A TREATMENT LINE

[75] Inventors: Paul Didier, Gueugnon; Dominique Henriet, Chambourcy, both of France

[73] Assignee: Ugine S.A., Puteaux, France

[21] Appl. No.: 972,644

[22] Filed: Nov. 6, 1992

[30] Foreign Application Priority Data

Nov. 7, 1991 [FR] France ..... 91 13752

[51] Int. Cl.[5] ..... C23G 1/08

[52] U.S. Cl. ..... 134/3; 134/41

[58] Field of Search ..... 134/41, 3; 29/DIG. 7

[56] References Cited

FOREIGN PATENT DOCUMENTS 507619 12/1951 Belgium .
2587369 3/1987 France .
2048311 12/1980 United Kingdom .

OTHER PUBLICATIONS

Patent Ab. of Japan Oct. 1986 Suehiro "Manf. of Cr Stainless Steel Plate" JP-A-61 117291.
Translations of Pertinent Portion of of Above Foreign Patents.
Patent Abstracts of Japan, vol. 10, No. 303 (C-378) (2359), Oct. 16, 1986, & JP-A-61 117 291, Toshiyuki Suehiro, "Manufacture of CR Stainless Steel Plate".

*Primary Examiner*—R. Bruce Breneman
*Assistant Examiner*—Thomas G. Dunn, Jr.
*Attorney, Agent, or Firm*—Oblon, Spivak, McClelland, Maier & Neustadt

[57] ABSTRACT

A method for pickling steel materials, in particular continuously on a treatment line, comprising a shot-blasting operation, a preparation operation, a pickling operation and a passivation operation, in which line the preparation operation is carried out by bringing the materials into contact with at least one 2 to 10N sulphuric acid solution, and in which line the pickling operation is carried out by bringing the materials into contact with at least one solution containing 1 to 10% by weight of hydrofluoric acid and $Fe^{2+}$ and $Fe^{3+}$ ions. No figure.

16 Claims, No Drawings

METHOD FOR CONTINUOUS PICKLING OF STEEL MATERIALS ON A TREATMENT LINE

The invention relates to a method for the treatment of metal materials, and more precisely for the pickling of steel materials continuously on a treatment line which may comprise, successively, a shot-blasting operation, a preparation operation, a pickling operation and a passivation operation.

The pickling method may be used on metal materials made of steel in an industrial environment, before leaving the works, for example for descaling, but also by non-professionals in metallurgy for cleaning steel items.

A pickling method of this type is known. In a line for continuous treatment of a steel product the treatment method used comprises, successively: a shot-blasting operation, a preparation operation by means of electrolytic pickling in sodium sulphate, or chemical pickling in a bath of molten salts of predetermined composition, for example: 90% NaOH, 9% $NaNo_3$, 1% NaCl, followed by a pickling operation and a passivation operation.

The preparation operation conditions the scale layers for the pickling operation, which dissolves the said layers. The pickling baths are based on hydrofluoric acid with an oxidising agent, which most frequently is nitric acid, but hydrogen peroxide may advantageously be used as oxidising agent. A passivation operation in an acid bath follows, the acid bath generally used being nitric acid.

This method has the disadvantage of being pollutant, the preparation operation giving rise to particularly toxic chromium compounds of oxidation number +VI, (Cr(VI)).

In fact, for example in a preparation of a stainless steel strip, the latter is moved through a bath composed of sodium sulphate in a proportion of 180 g/l at 80° C. under a current density of 2 $A/dm^2$.

It has been found that during this operation the electrolysis gives rise to the formation of Cr(VI), the compounds of which are known for their toxicity.

Furthermore, the pickling operation making use of a mixture of nitric acid and HF also gives rise to the evolution of particularly toxic nitrogen oxide or nitrogen dioxide vapours and salting-out of nitrogen-containing compounds, such as nitrites and nitrates, in the effluents. Although the permitted maximum limiting content for nitrates is relatively high, that relating to nitrites is very much lower because nitrites lead to the formation of noxious nitrosamines.

The aim of the invention is to overcome nuisances such as the formation of Cr(VI) compounds, the evolution of nitrous vapours or the salting-out of nitrite compounds described above, and also to reduce the treatment time for the materials.

The invention relates to a method for pickling steel materials, in particular continuously on a treatment line, comprising a shot-blasting operation, a preparation operation and then at least one pickling operation and at least one passivation operation, characterised in that the preparation operation is carried out by bringing the materials into contact with at least one 2 to 10N sulphuric acid solution at a temperature higher than 50° C., the metals content being below the saturation level, and in that the pickling operation is carried out by bringing the materials into contact with at least one solution which has a temperature of between 40° and 95° C. and contains 1 to 10% by weight of hydrofluoric acid, and $Fe^{2+}$ and $Fe^{3+}$ ions, such that the $Fe^{3+}$ ion concentration is between 1 and 190 g/l and that the redox potential is between −200 and +800 mV, this potential being measured using a platinum electrode with respect to an Ag/AgCl electrode.

According to the invention, the chemical dissolution of steel in $H_2SO_4$ does not permit the oxidation of Cr(III) to Cr(VI) during the preparation operation. In fact, the following reactions are observed:

$$Fe + H_2SO_4 \rightarrow H_2 + Fe\ SO_4$$

$$2\ Cr + 3H_2SO_4 \rightarrow 3H_2 + Cr\ (SO_4)_3$$

Furthermore, the absence of nitric acid in the pickling solution makes it possible to suppress all evolution of nitrogen oxide or nitrogen dioxide as well as all salting-out of nitrogen-containing compounds, such as nitrites and nitrates in the effluents.

During this pickling operation, the base metal, Fe, is dissolved by the oxidizing agents, mainly $Fe^{3+}$ but also HF, in accordance with the reactions:

$$2\ Fe^{3+} + Fe \rightarrow 3\ Fe^{2+}$$

$$Fe + 2HF \rightarrow H_2 + Fe\ F_2$$

The oxidation-reduction or REDOX potential is the potential difference measured between a non-corrodible electrode (for example made of platinum) and a reference electrode (Ag/AgCl), these two electrodes being immersed in the pickling solution. The value determined makes it possible to characterize the oxidising power of the pickling solution and to derive values for the $Fe^{3+}$ concentration and, from the temperature of the pickling solution, the value of the $Fe^{2+}$ concentration.

Preferably, the pickling operation is carried out by bringing the materials into contact with several successive solutions and still more preferentially with two successive solutions.

Furthermore, the pickling solution preferably has a $Fe^{3+}$ ion concentration of 30 g/l, a temperature of 50° C. and a redox potential of between 100 and 250 mV measured using a platinum electrode with respect to an Ag/AgCl electrode.

The passivation operation is carried out by bringing the materials into contact with at least one solution chosen from a sulphuric acid solution containing $F^{3+}$ ions, a phosphoric acid solution, a hydrogen peroxide solution or a nitric acid or iron nitrate solution.

According to a preferred embodiment of the invention, the preparation solution has a sulphuric acid concentration of 4N and a temperature of 80° C.

The preparation, pickling and passivation operations may be carried out in various ways, in particular by immersion, spraying or sprinkling.

The following example describes one embodiment of the invention.

EXAMPLE

A steel strip is pickled on a continuous treatment line.

The steel strip is subjected to preliminary shot-blasting, followed by a preparation operation comprising consecutive immersion of the steel strip in two sulphuric acid baths having a concentration of 4N, at a temperature of 85° C., the metal content being below the saturation level, that is to say less than 100 g/l.

The steel strip is then immersed in two consecutive pickling baths having a hydrofluoric acid concentration of 2% by weight, a $Fe^{3+}$ ion concentration of 30 g/l, a temperature of 50° C. and a redox potential of 180 mV measured with respect to a platinum electrode and a reference Ag/AgCl electrode.

After pickling, the steel strip is treated in a nitric acid bath for passivation.

The production of Cr(VI) proved to be less than 0.1 mg per tonne of product treated and the emission of nitrous vapours ($NO_x$) is zero.

Furthermore, this highly efficient pickling method makes it possible to reduce the time necessary for treatment of the products by about 25%.

We claim:

1. Method for pickling steel materials consisting essentially of a shot-blasting operation, a preparation operation and then at least one pickling operation and at least one passivation operation, characterized in that the preparation operation is carried out by bringing the materials into contact with at least one 2 to 10N sulphuric acid solution at a temperature higher than 50° C., the metals content being below the saturation level, and in that the pickling operation is carried out by bringing the materials into contact with at least one solution which has a temperature of between 40° and 95° C. and consists essentially of 1 to 10% by weight of hydrofluoric acid, and $Fe^{2+}$ and $Fe^{3+}$ such that the $Fe^{3+}$ ion concentration is between 1 and 190 g/l and that the redox potential is between −200 and +800 mV, this potential being measured using a platinum electrode with respect to an Ag/AgCl electrode.

2. Method according to claim 1, characterized in that the pickling operation is carried out by bringing the materials into contact with several successive solutions.

3. Method according to claims 1 or claim 2, characterized in that the pickling operation is carried out by bringing the materials into contact with two successive solutions.

4. Method according to claim 1 or claim 2, characterized in that the pickling solution has a $Fe^{3+}$ ion concentration of 30 g/l, a temperature of 50° C. and a redox potential of between 100 and 250 mV measured using a platinum electrode with respect to an Ag/AgCl electrode.

5. Method according to claim 1, characterized in that the passivation operation is carried out by bringing the materials into contact with at least one solution chosen from a sulphuric acid solution containing $Fe^{3+}$ ions, a phosphoric acid solution, a hydrogen peroxide solution or a nitric acid or iron nitrate solution.

6. Method according to claim 1, characterized in that the preparation solution has a sulphuric acid concentration of 4N and a temperature of 80° C.

7. Method according to claim 1, characterized in that the preparation, pickling and passivation operations are carried out by immersion, spraying or sprinkling.

8. The method according to claim 3, characterized in that the pickling solution has a $Fe^{3+}$ ion concentration of 30 g/l, a temperature of 50° C. and a redox potential of between 100 and 250 mV measured using a platinum electrode with respect to an Ag/AgCl electrode.

9. The method of claim 1, wherein said method is carried out continuously on a treatment line.

10. The method according to claim 1, wherein said at least one pickling solution contains no nitric acid.

11. The method of claim 4, wherein said at least one pickling solution contains no nitric acid.

12. The method according to claim 1, wherein said pickling operation is carried out in the absence of nitric acid.

13. The method according to claim 10, wherein each preparation operation consists of bringing the materials into contact with one or more solutions consisting of 2–10N aqueous sulfuric acid.

14. The method according to claim 11, wherein said preparation operation consists of bringing the materials into contact with one or more solutions consisting of 2–10N aqueous sulfuric acid.

15. The method according to claim 12, wherein said preparation operation consists of bringing the materials into contact with one or more solutions consisting of 2–10N aqueous sulfuric acid.

16. The method according to claim 15, consisting essentially of a shot-blasting operation, a preparation operation, at least one pickling operation and at least one passivation operation.

* * * * *